US009873583B2

(12) United States Patent
Jin et al.

(10) Patent No.: US 9,873,583 B2
(45) Date of Patent: Jan. 23, 2018

(54) BANKNOTE STACKING DEVICE

(71) Applicant: GRG Banking Equipment Co., Ltd., Guangzhou, Guangdong (CN)

(72) Inventors: Yougang Jin, Guangzhou (CN); Shaohai Huang, Guangzhou (CN); Hongjun Wu, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/784,934

(22) PCT Filed: Feb. 13, 2014

(86) PCT No.: PCT/CN2014/072036
§ 371 (c)(1),
(2) Date: Oct. 15, 2015

(87) PCT Pub. No.: WO2014/187176
PCT Pub. Date: Nov. 27, 2014

(65) Prior Publication Data

US 2016/0145066 A1 May 26, 2016

(30) Foreign Application Priority Data

May 20, 2013 (CN) ..... 2013 1 0187860

(51) Int. Cl.
*B65H 29/14* (2006.01)
*B65H 43/00* (2006.01)
(Continued)

(52) U.S. Cl.
CPC ..... *B65H 29/14* (2013.01); *B65H 5/023* (2013.01); *B65H 29/70* (2013.01);
(Continued)

(58) Field of Classification Search
CPC .... B65H 5/023; B65H 31/36; B65H 31/3027; B65H 29/14; B65H 2301/4212; B65H 2701/1912; B65H 2404/2691
(Continued)

(56) References Cited

U.S. PATENT DOCUMENTS 4,642,013 A * 2/1987 Mundus ..... B31B 19/98 198/468.8
5,897,114 A * 4/1999 Arikawa ..... B65H 31/3027 271/272
7,988,146 B2 8/2011 Chou

FOREIGN PATENT DOCUMENTS

CN 2531460 Y 1/2003
CN 1654292 A 8/2005
(Continued)

OTHER PUBLICATIONS

International Search Report, date May 7, 2014, from corresponding International Application No. PCT/CN2014/072063dated Oct. 22, 2014.
(Continued)

*Primary Examiner* — Patrick Cicchino
(74) *Attorney, Agent, or Firm* — Wolf, Greenfield & Sacks, P.C.

(57) ABSTRACT

A banknote stacking device includes a piece-by-piece banknote conveying mechanism, an upper conveyor belt, an arc-shaped stacking plate, a movable blocking mechanism, a sensor device, and a control unit. An elastic sheet is arranged on the arc-shaped stacking plate at a position for stacking banknotes, an end of the elastic sheet is fixed on the arc-shaped stacking plate, and a free end of the elastic sheet extends in a direction opposite to the conveying direction of the banknotes, the extending segment of the elastic sheet forms an arch and is configured to elastically support the upper conveyor belt, and a through-groove is provided in the
(Continued)

arc-shaped stacking plate at a position corresponding to the elastic sheet, and the free end of the elastic sheet is configured to extend and retract freely in the through-groove.

5 Claims, 8 Drawing Sheets

(51) Int. Cl.

| | |
|---|---|
| ***B65H 31/30*** | (2006.01) |
| ***B65H 31/36*** | (2006.01) |
| ***B65H 29/70*** | (2006.01) |
| ***B65H 5/00*** | (2006.01) |
| ***G07D 11/00*** | (2006.01) |
| ***B65H 5/02*** | (2006.01) |

(52) U.S. Cl.
CPC ..... *B65H 31/3027* (2013.01); *B65H 31/36* (2013.01); *B65H 43/00* (2013.01); *G07D 11/0018* (2013.01); *B65H 2301/4212* (2013.01); *B65H 2301/4213* (2013.01); *B65H 2301/51214* (2013.01); *B65H 2404/2641* (2013.01); *B65H 2404/2691* (2013.01); *B65H 2405/1114* (2013.01); *B65H 2408/13* (2013.01); *B65H 2701/1912* (2013.01)

(58) Field of Classification Search
USPC ..... 271/160
See application file for complete search history.

(56) References Cited

FOREIGN PATENT DOCUMENTS

| | | | |
|---|---|---|---|
| CN | 1881266 | A | 12/2006 |
| CN | 201362521 | Y | 12/2009 |
| CN | 102930639 | A | 2/2013 |
| CN | 102968851 | A | 3/2013 |
| CN | 103268665 | A | 8/2013 |
| JP | S6137658 | A | 2/1986 |
| JP | H09151009 | A | 6/1997 |
| KR | 102006000842 | | 8/2006 |

OTHER PUBLICATIONS

Chinese Office Action, dated Sep. 14, 2014, from corresponding Chinese Application No. 201310187860.6.

* cited by examiner

BANKNOTE STACKING DEVICE

This application is the national phase of International Application No. PCT/CN2014/072036, titled "BANKNOTE STACKING DEVICE", filed on Feb. 13, 2014, which claims the benefit of priority to Chinese Patent Application No. 201310187860.6 titled "BANKNOTE STACKING DEVICE", filed with the Chinese State Intellectual Property Office on May 20, 2013, the entire disclosures of both applications are incorporated herein by reference.

TECHNICAL FIELD

The present application relates to a technique for processing a sheet-type medium, and particularly to a device for end-to-end stacking sheet-type medium, such as banknotes, piece by piece.

BACKGROUND

A device for piece-by-piece identifying banknotes to be processed is generally required to be installed in the machine for processing financial bills, and after being identified piece by piece, the banknotes which are conveyed piece by piece are stacked to facilitate withdrawing the banknotes. For example, in a conventional automatic teller machine, multiple sheets of stacked banknotes are sorted, conveyed and identified piece by piece, and then are stacked to be delivered out. At present, in a banknote stacking device, in which the banknote is separated, conveyed and stacked in a longitudinal direction, a conveyor belt fits closely to an arc-shaped plate to convey a single sheet of banknote to a specific location to be stacked. For example, the first sheet of banknote is settled in the specific location, a front end of the second sheet of banknote is superposed on a tail end of the first sheet of banknote, and the first sheet of banknote and the second sheet of banknote are clamped by the conveyor belt and the arc-shaped plate to move forwards together, and the first sheet of banknote stops moving forward when its front end reaches a predetermined blocking member. The second sheet of banknote is driven by the conveyor belt to overcome the frictional force between the banknotes and continue to slide forward, and stops moving forward until it reaches the predetermined blocking member. The third sheet of banknote and subsequent banknotes go through the same process as the first and second sheets of banknotes, that is, the front end of a subsequent sheet of banknote is superposed on the tail end of a previous banknote and the banknotes are all conveyed to the predetermined blocking member, to be stacked. Eventually, the front ends of all the banknotes are aligned to the predetermined movable blocking plate, and a whole stack of banknotes are delivered to a predetermined position for an operator.

In the conventional mechanism, however, as the banknotes accumulate, each subsequent sheet of banknote needs to climb a slope at the tail ends of the stacked banknotes. If any one of two adjacent sheets of banknotes to be stacked has a slit, the banknote is apt to be jammed at the slit. Further, due to the support of the stacked banknotes, a triangular empty area is formed among the conveyor belt, the arc-shaped plate, and the tail end surface of the stacked banknotes, and in the case that the banknote has a severe fold, the banknote has a weak strength at the fold and is apt to be folded and arched in the triangular empty area, which may affect the orderly stacking of the subsequent banknotes. In the above two situations, when the stacked banknotes reach a certain height, a banknote with a slit or a soft and old banknote with a severe fold is apt to cause the banknotes to be stacked disorderly, even cause a banknote jam.

SUMMARY

An object of the present application is to provide a banknote stacking device for effectively stacking banknote having a slit or being soft and old.

The banknote stacking device includes the following mechanisms:

- a piece-by-piece banknote conveying mechanism configured to convey a single sheet of banknote;
- an upper conveyor belt configured to provide a driving force to the banknote and arranged around a driving wheel, driven wheels and a pinch roller which are arranged in a conveying direction of the banknote;
- an arc-shaped stacking plate configured to support the banknote, wherein the upper conveyor belt fitting closely to an arc-shaped surface of the arc-shaped stacking plate to define a conveying passage for the banknote, a length of the conveying passage is at least greater than a length of one sheet of the banknote in the conveying direction, and one end of the conveying passage abuts the piece-by-piece banknote conveying mechanism and is slightly lower than a delivering outlet of the conveying mechanism, and another end of the conveying passage forms a discharging port for a whole stack of banknotes;
- a movable blocking mechanism arranged on a section of the conveying passage close to the discharging port and configured to selectively block the banknote;
- a sensor device arranged at a tail end of the delivering outlet of the piece-by-piece banknote conveying mechanism and configured to detect the arrival and passing of a sheet of the banknote; and
- a control unit configured to control the upper conveyor belt to move or stop moving according to information feedback from the sensor device;
- wherein, an elastic sheet is arranged on the arc-shaped stacking plate at a position for stacking banknotes, an end of the elastic sheet is fixed on the arc-shaped stacking plate, and a free end of the elastic sheet extends in a direction opposite to the conveying direction of the banknotes, the extending segment of the elastic sheet forms an arch and is configured to elastically support the upper conveyor belt, and a through-groove is provided in the arc-shaped stacking plate at a position corresponding to the elastic sheet, and the free end of the elastic sheet is configured to extend and retract freely in the through-groove.

Preferably, the arc-shaped stacking plate includes three sections, a section near the piece-by-piece banknote conveying mechanism forms a rear arc-shaped plate, a section near the discharging outlet forms a front arc-shaped plate, and a middle section forms a direction reversing device, wherein, the elastic sheet is arranged on the front arc-shaped plate, and an end of the rear arc-shaped plate close to the front arc-shaped plate tilts upward to be higher than a surface of the front arc-shaped plate to form a height difference.

Further, at least one pair of convex ribs are formed on the surface of the rear arc-shaped plate at two sides of the upper conveyor belt, and a distance between the pair of convex ribs is smaller than the minimum dimension of the banknote in a direction perpendicular to the conveying direction.

Further, a floating pinch roller is provided on a side, away from the arc-shaped plate, of the upper conveyor belt at a position corresponding to the convex ribs, and is configured to increase a conveying force of the upper conveyor belt to the banknote.

Preferably, a recycling conveyor belt assembly and a discharging conveyor belt assembly are arranged below the direction reversing device and the front arc-shaped plate, wherein at least a section of the recycling conveyor belt assembly fits with a section of the discharging conveyor belt assembly to form a recycling conveying passage for the banknote.

Compared with the conventional technology, the valuable document identifying device of the present application has the following advantages.

By arranging the elastic sheet at the banknote stacking position of the arc-shaped stacking plate, when stacking the banknotes, the banknotes are clamped between the elastic sheet and the first conveyor belt and then are driven by the first conveyor belt to move forward. When more of the banknotes are stacked, the elastic sheet is lowered due to the pressing of the upper conveyor belt and the banknotes, to allow the tail end of the banknote to be flush with the action surface of the arc-shaped passage plate. Thus, the banknote is not required to climb a slope at the tail end of the stacked banknotes, and the deformation of the upper conveyor belt is small and the pressure on the banknotes from the upper conveyor belt is basically constant, which may effectively reduce the probability of banknote jam caused by the banknote having a crack or a severe fold, and allow the banknotes to be stacked as desired.

DETAILED DESCRIPTION

For further illustrating a banknote stacking device according to the present application and clearly describing the structure and operation process of the device, a teller machine used in a financial self-service equipment is described as an example.

Figure 1:
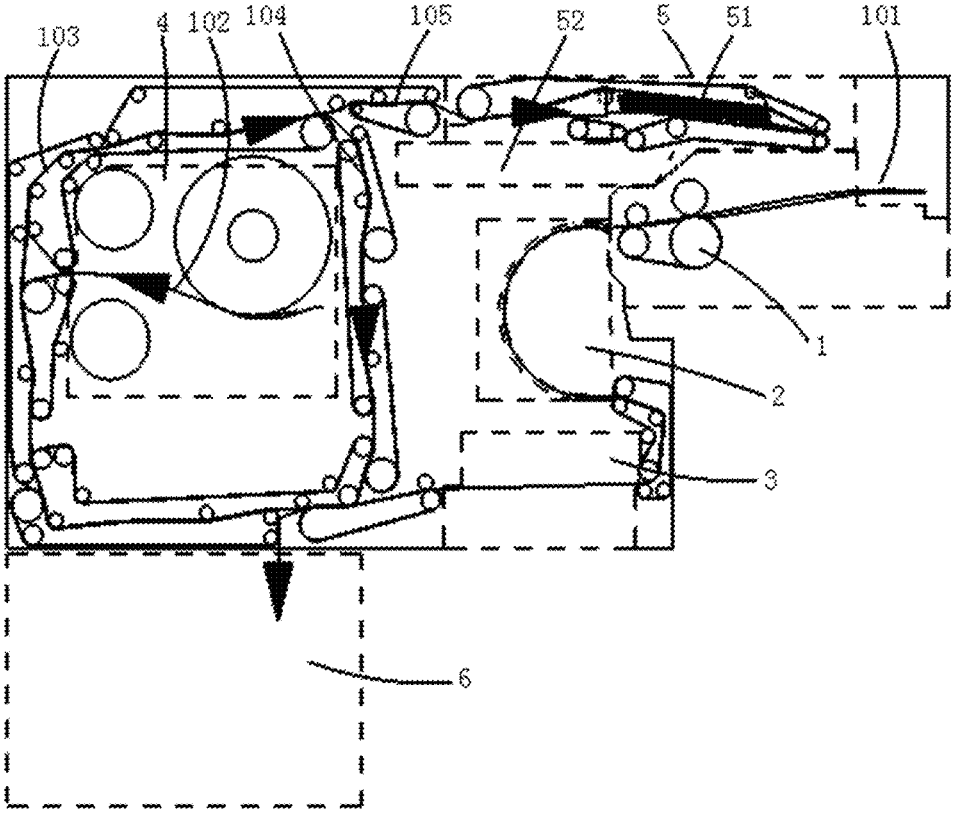
FIG. 1 is a schematic view showing the structure of a banknote stacking device according to the present application.

Reference is made to FIG. 1, which is a schematic view showing the structure of a banknote stacking device (i.e., a teller machine). The teller machine has a depositing port 101, a sheet separating device 1, a sheet tilt correction device 2, a sheet identifying device 3, a temporary storage device 4, a stacking and recycling device 5 and a storage box 6. The sheet separating device 1 separates banknotes at the depositing port 101 piece by piece and delivers the separated banknotes into the teller machine. The sheet tilt correction device 2 is configured to adjust the banknotes inclined with respect to an advancing direction and align the banknotes with a datum plane in parallel with the advancing direction. The sheet identifying device 3 is configured to identify the authenticity, the face value, the obverse and reverse, and the condition of banknotes and checks and to detect whether the sheets are conveyed abnormally, such as being titled, overlapped or continuous, to determine whether the sheets can be stored. The temporary storage device 4 is configured to temporarily store banknotes or checks which are identifiable and are determined as being conveyed normally. The stacking and recycling device 5 is configured to stack banknotes or checks, to deliver out returned banknotes or checks, and to recycle the banknotes or checks that customers forget to take away. Conveying mechanisms 102, 103, 104 and 105 for conveying banknotes piece by piece are provided between the above devices to convey banknotes.

Figure 2:
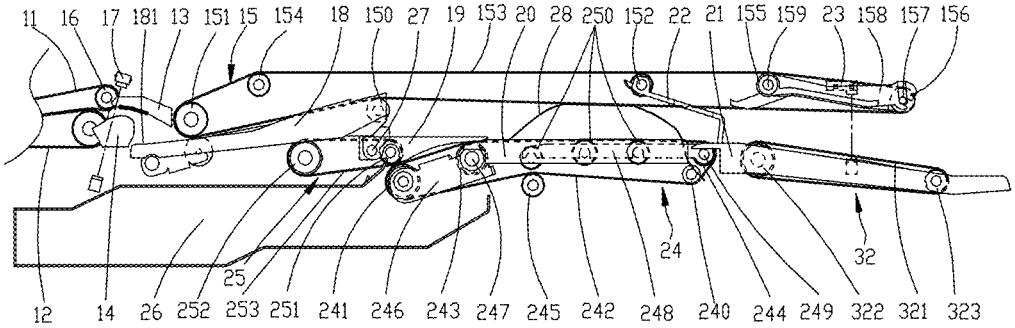
FIG. 2 is a schematic view showing the structure of a stacking and recycling device of the banknote stacking device shown in FIG. 1.

Reference is made to FIG. 2. The stacking and recycling device 5 includes an upper conveyor belt 153 for providing a driving force to the banknotes, an arc-shaped stacking plate for supporting the banknotes, a movable blocking mechanism 22 for selectively blocking the banknotes, a sensor device 17 and a control unit. The upper conveyor belt 153 is arranged around a driving wheel 151, driven wheels 150, 154, 155 and a pinch roller 156 which are arranged in a conveying direction of the banknotes. The arc-shaped stacking plate includes three function sections; the section, near the conveying mechanism for conveying banknotes piece by piece, forms a rear arc-shaped plate 18; the section near a medium discharging port forms a front arc-shaped plate 20; and the middle section forms a direction reversing device 19. The upper conveyor belt and the arc-shaped stacking plate are used to clamp and convey the banknotes, thereby forming a conveying passage for the banknote. The length of the conveying passage is at least greater than the length of one sheet of the banknote in the conveying direction. One end of the conveying passage abuts the conveying mechanism 105 for conveying banknotes piece by piece and is slightly lower than a delivering outlet of the conveying mechanism. Another end of the conveying passage forms the discharging port for a whole stack of banknotes. The movable blocking mechanism 22 is arranged on a section of the conveying passage close to the discharging port. The sensor device 17 is arranged at the tail end of the delivering outlet of the conveying mechanism for conveying banknotes piece by piece and is configured to detect the arrival and passing of a sheet of the banknote. The control unit is configured to control the upper conveyor belt 153 to move or stop moving according to the information feedback from the sensor device 17, thereby end-to-end connecting the adjacent banknotes entering into the arc-shaped stacking device. For facilitating discharging the whole stack of banknotes, a discharging clamping segment 21 is arranged at the tail end of the front arc-shaped plate 20 close to the movable blocking mechanism 22. In order to convey the banknotes in the entire conveying passage, a first conveying assembly 15 is formed by the upper conveyor belt 153. Similar to the first conveying assembly 15, a second conveying assembly 24, a third conveying assembly 25, and a fourth conveying assembly 32 are arranged corresponding to the front arc-shaped plate 20, the direction-reversing device 19, and the discharging clamping segment 21, respectively. The end of the rear arc-shaped plate 18 close to the front arc-shaped plate 20 tilts upward to be higher than the surface of the front arc-shaped plate 20, to form a height difference. An elastic sheet 28 is arranged on the front arc-shaped plate 20 at the position for stacking the banknotes. An end of the elastic sheet 28 is fixed on the front arc-shaped plate 20, and a free end of the elastic sheet 28 extends in a direction opposite to the conveying direction of the banknotes. The extending segment of the elastic sheet 28 forms an arch and is used to elastically support the upper conveyor belt 153. A through-groove is provided in the front arc-shaped plate 20 at the position corresponding to the elastic sheet 28, and the free end of the elastic sheet can extend and retract freely in the through-groove.

Figure 3:
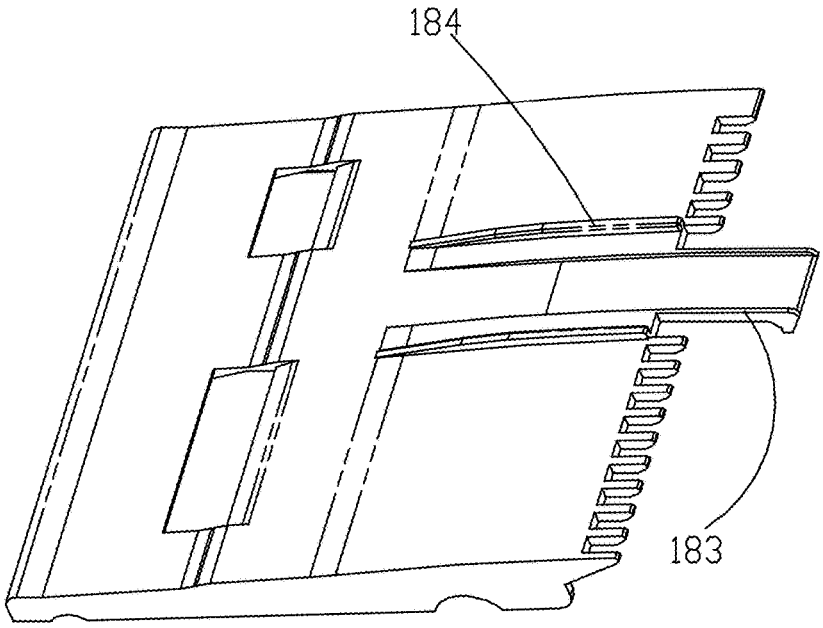
FIG. 3 is a partial schematic view of an arc-shaped stacking plate of the stacking and recycling device in FIG. 2.
Figure 4:
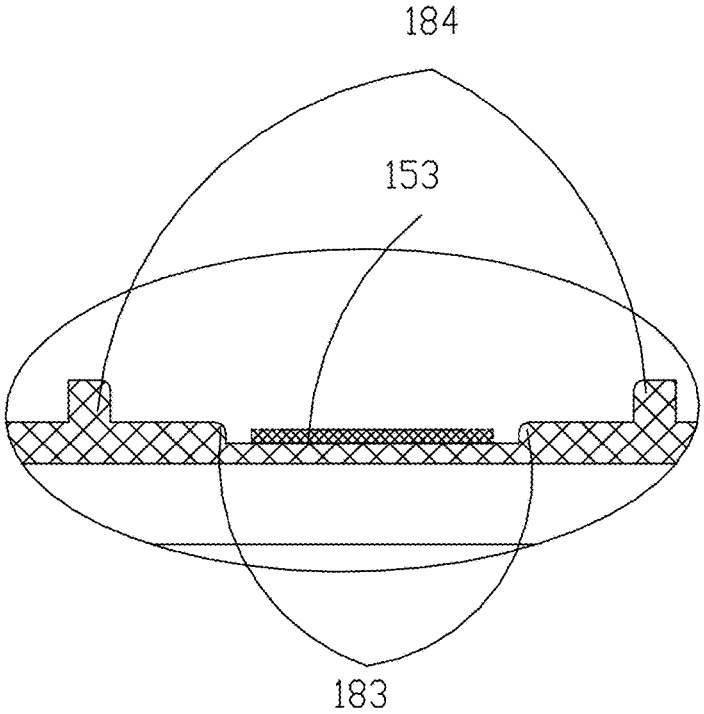
FIG. 4 is a sectional view of the arc-shaped stacking plate in FIG. 3.
Figure 5:
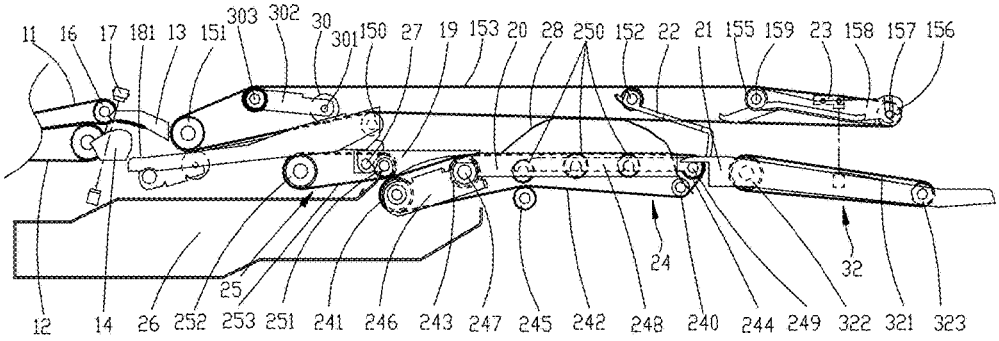
FIG. 5 is a schematic view of the banknote stacking device in FIG. 1 which is further provided with a floating roller.

Reference is made to FIG. 3 and FIG. 4. When the banknote has a severe fold, the banknote has a weak strength at the fold, which may affect the orderly stacking of the subsequent banknotes. Thus, two pairs of convex ribs 183, 184 are formed on a section of the arc-shaped surface of the rear arc-shaped plate 18 at two sides of the upper conveyor belt 153. A distance between each pair of convex ribs 183, 184 is smaller than the minimum dimension of the banknote in a direction perpendicular to the conveying direction. Reference is made to FIG. 5. To increase the conveying force of the upper conveyor belt to the banknote at the position of the convex ribs, a floating pinch roller 30 is provided on a side, away from the arc-shaped plate 18, of the upper conveyor belt at a position corresponding to the convex ribs 183, and is fixed at an end of a floating plate 302 via a mandrel 301. The floating plate 302 is pivotally mounted on a mandrel 303.

Figure 19:
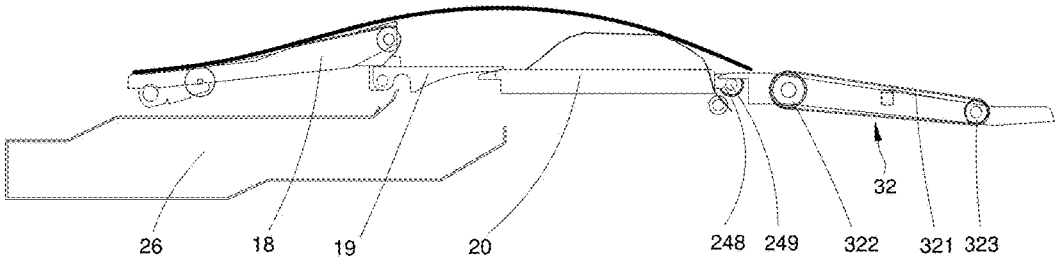
FIG. 19 is a schematic view showing a contour of a banknote as it travels over the arc-shaped stacking plate.

Reference is made to FIG. 19, which shows a contour of a banknotice indicated by the black heavy line (for example, p1), as it travels over the arc-shaped stacking plate.

Referring to FIG. 1, the specific working process of the teller machine is illustrated herein. When depositing, a customer puts one or more sheets of banknotes at the depositing port 101, and the banknotes are separated by the sheet separating device 1 piece by piece and then pass through the sheet tilt correction device 2 and the sheet identifying device 3. The banknotes determined to be normal and the face value of which has been identified or the checks which are identifiable enter into the temporary storage device 4 via a route 102. The banknotes or checks which are unidentifiable are returned to the stacking and recycling device 5 via a route 103 and a routine 105, and then are aligned and stacked at the stacking unit 51, and the returned banknotes are stacked and then delivered out after the banknotes at the depositing port 101 are completely separated. When it is determined that the returned banknotes or checks are not taken away by the operator in a specific time, the banknotes or checks are recycled to the recycling unit 26.

Figure 6:
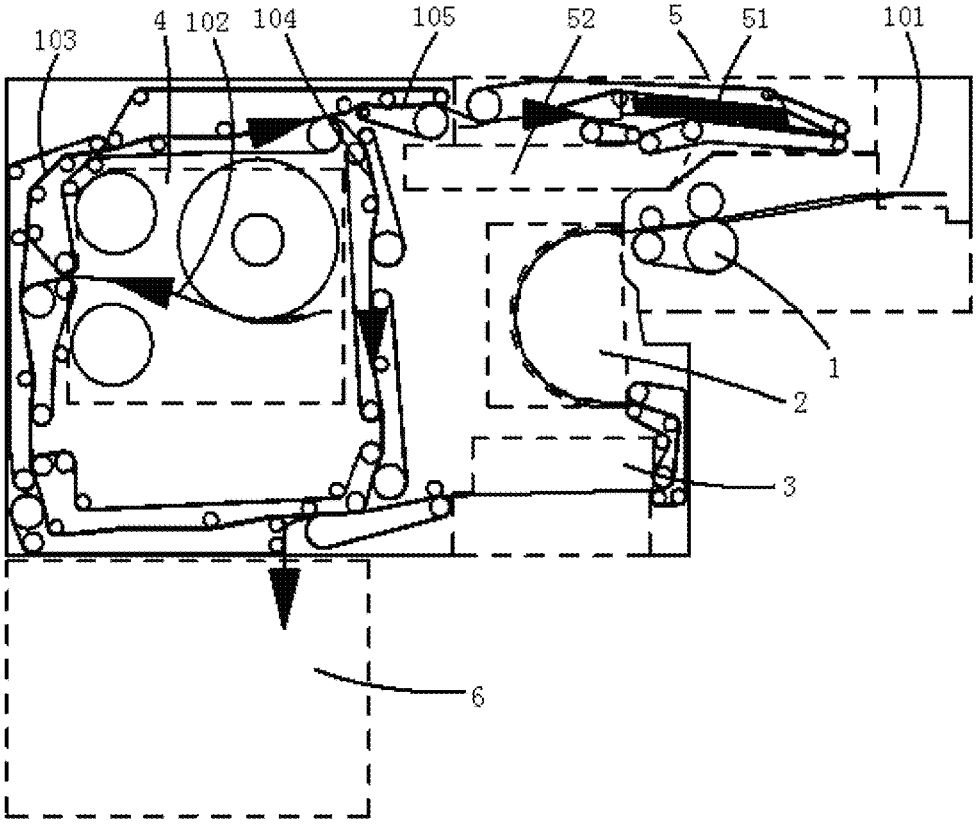
FIG. 6 is a schematic view showing the banknote depositing and withdrawing process of the banknote stacking device in FIG. 1.

Referring to FIG. 6, the banknotes depositing and returning process of the teller machine is described herein. After the banknotes are completely separated piece by piece, the banknotes determined to be normal and the face value of which has been identified are conveyed into the temporary storage device 4 to wait for the customer to confirm the depositing operation, and if the customer confirms depositing, the banknotes are conveyed out of the temporary storage 4 and then conveyed into the storage box 6 via a routine 104, thereby implementing the banknote depositing process. If the customer cancels depositing, the banknotes are conveyed out of the temporary device 4 and conveyed to the stacking and recycling device 5 via the routine 105, and then are aligned and stacked in the stacking unit 51, and finally are stacked and then delivered out, thereby implementing the banknote returning process. When it is determined that the returned banknotes are not taken away by the customer in a specific time, the banknotes are recycled to the recycling unit 26.

Figure 7:
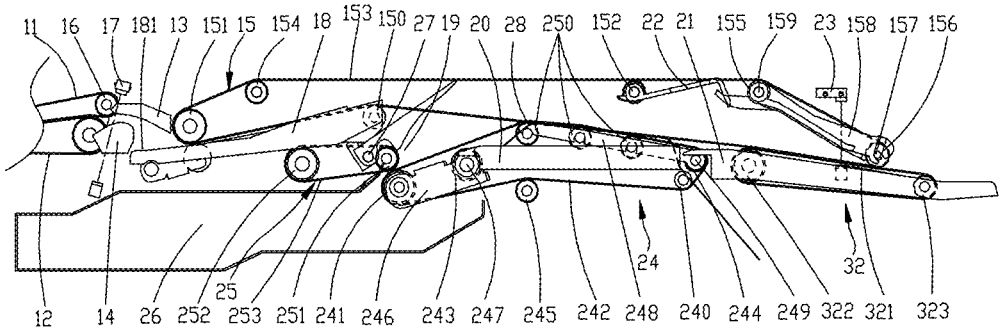
FIG. 7 is a side view of the stacking and recycling device in FIG. 2 with a movable blocking plate in an open state and a direction reversing device at a second position.

Reference is made to FIG. 2 and FIG. 7. The banknotes are returned via the routine 105 and are clamped between an upper delivering conveyor belt 11 and a lower delivering conveyor belt 12 piece by piece to be conveyed to the stacking and recycling device 5. An upper guiding board 13 and a lower guiding board 14 are arranged in the advancing direction of the discharged banknotes. The first conveying assembly 15 arranged in parallel to the advancing direction of the banknotes is provided in front (the rightward direction in the figures) of the upper guiding board 13. A first sensor device 17 is arranged between the driving roller 151 and the delivering roller 16, and is configured to detect each sheet of discharged banknote. The rear arc-shaped plate 18, the front arc-shaped plate 20 and the direction reversing device 19 are provided below the first conveying assembly 15, and a rear-end plane 181 of the rear arc-shaped plate 18 is obviously lower than the outlet (a port for discharging the sheets) formed between the upper delivering conveyor belt 11 and the lower delivering conveyor belt 12. Above the front section of the front arc-shaped plate 20, the movable blocking plate 22 is pivotally mounted on a mandrel 152 and has two working states, including a closed state as shown in FIG. 2 and an open state as shown in FIG. 7. A second sensor device 23 is fixed in front of the movable blocking plate 22 and is configured to detect the presence of banknotes in front of the movable blocking plate 22 and above the discharging clamping segment 21. The adjustable second conveying assembly 24 is arranged below the front arc-shaped plate 20, and the fourth conveying assembly 32 is arranged at the discharging clamping segment 21 corresponding to the second sensor 23. The first conveying assembly 15, the second conveying assembly 22, the third conveying assembly 25 and the fourth conveying assembly 32 are driven by the same power. The recycling unit 26 is a storage container, and an inlet of the storage container 26 is corresponding to a conveying port formed by a recycling floating roller 241 and a driven roller 251 of the third conveying assembly 25. The direction reversing device 19 is arranged between the rear arc-shaped plate 18 and the front arc-shaped plate 20 and above the conveying port formed by the recycling floating roller 241 and the driven roller 251, and is pivotally mounted on a mandrel 27, and has two working states, including a first position as shown in FIG. 2 and a second position as shown in FIG. 7.

Figure 8:
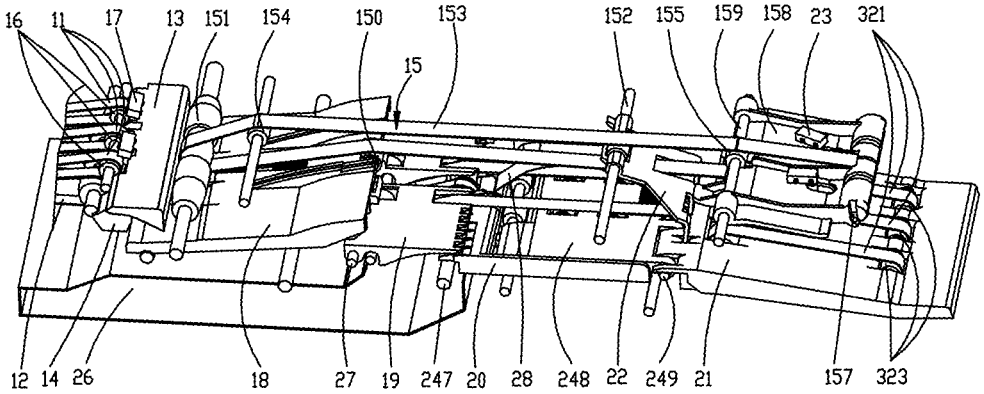
FIG. 8 is an axonometric view of the stacking and recycling device in FIG. 2.
Figure 9:
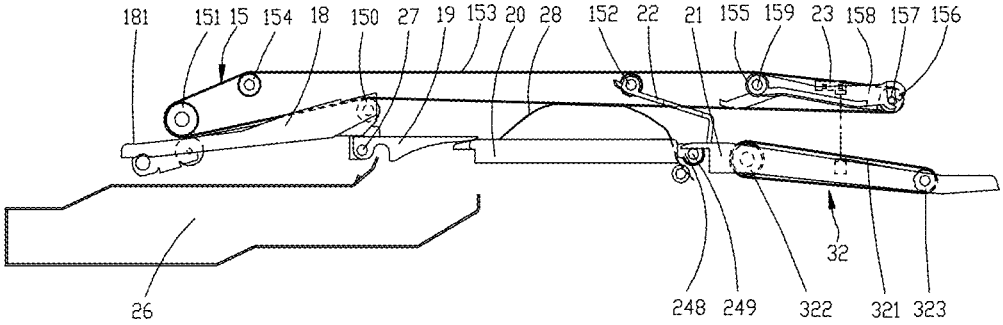
FIG. 9 is a side view of a first conveyor belt assembly of the stacking and recycling device in FIG. 2.

Referring to FIG. 8 and FIG. 9, the first conveying assembly 15 is illustrated in detail. A first conveyor belt 153 (that is the upper conveyor belt) of the first conveying assembly 15 is arranged around the driving roller 151, a roller 150, a roller 154, a roller 155 and the pinch roller 156. The lower section of the first conveyor belt 153 is tensed by the upper surfaces of the rear arc-shaped plate 18 and the front arc-shaped plate 20. The pinch roller 156 is fixed at the front end of the pressing plate 158 via a mandrel 157, and the pressing plate 158 is swingable around the mandrel 159.

Figure 10:
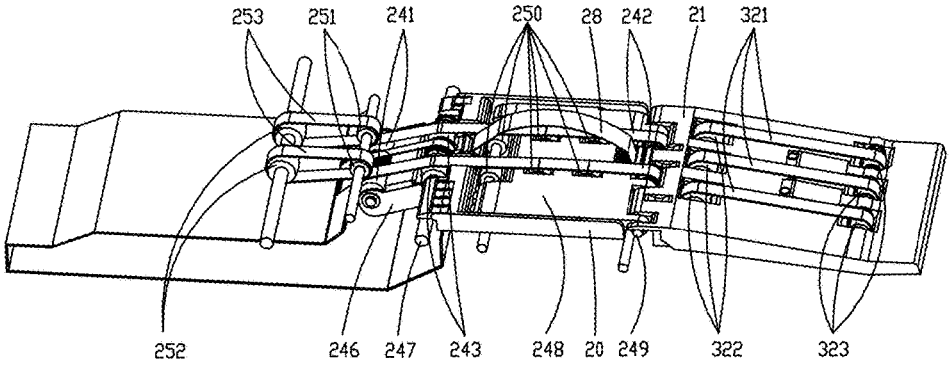
FIG. 10 is an axonometric view of a second conveyor belt assembly and a third conveyor belt assembly of the stacking and recycling device in FIG. 2.
Figure 11:
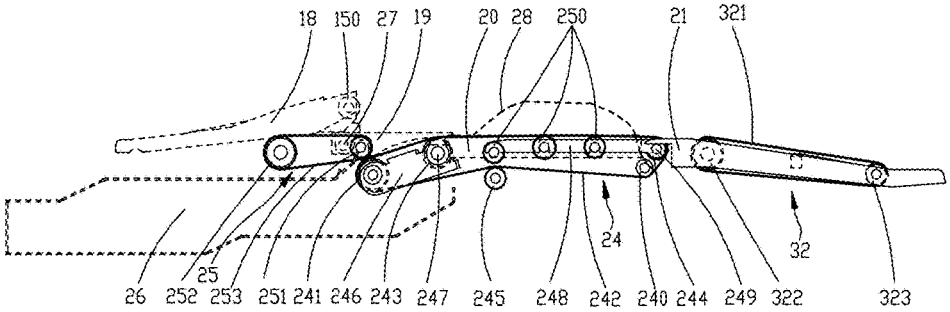
FIG. 11 is a side view of the second conveyor belt assembly and the third conveyor belt assembly of the stacking and recycling device in FIG. 2.
Figure 12:
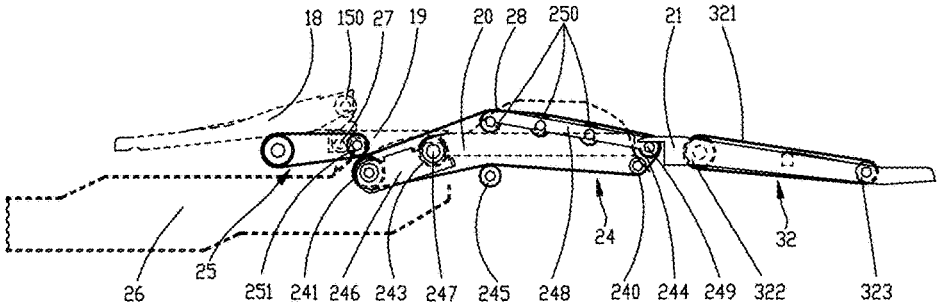
FIG. 12 is a side view of the second conveyor belt assembly and the third conveyor belt assembly when a floating support of the stacking and recycling device is at a second position.

Referring to FIGS. 10 to 12, the second conveying assembly and the third conveying assembly of the stacking and recycling device are illustrated. Two abreast second conveyor belts 242 of the second conveying assembly 24 are arranged around the recycling floating roller 241, the second driving roller 243, a second pinch roller 244 and tensioning rollers 245, 240. The recycling floating roller 241 is mounted on a recycling floating support 246 through a pair of bearings and is swingable around a mandrel 247. A banknote-delivering floating support 248 swingable around a mandrel 249 is mounted at a front end of the second conveying assembly 24, and has two working states. The swinging of the delivering floating support 248 and the movable blocking plate 22 are driven by the same power. The delivering floating support 248 is provided with three rows of roller sets 250 corresponding to the second conveyor belt 242. The roller sets 250 may make the working surface of the second conveyor belt 242 higher or lower than the arc-shaped surface of the front arc-shaped plate 20 through the swinging of the delivering floating support 248. A third conveyor belt 253 of the third conveying assembly 25 is arranged around a third driving roller 252 and the driven roller 251. A fourth conveyor belt 321 of the fourth conveying assembly 32 is arranged around a fourth driving roller 322 and a driven roller 323, and a working surface of the fourth conveyor belt 321 is higher than a working surface of the discharging clamping segment 21.

Figure 13:
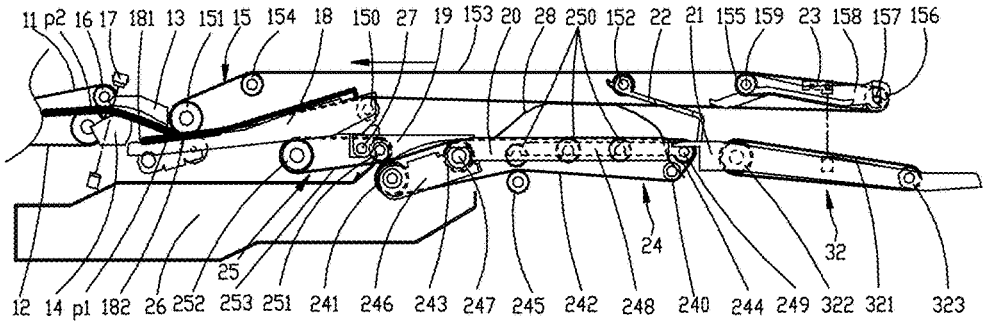
FIG. 13 is a flowing chart of the stacking and recycling device in FIG. 2 conveying a first sheet of banknote and a second sheet of banknote.
Figure 14:
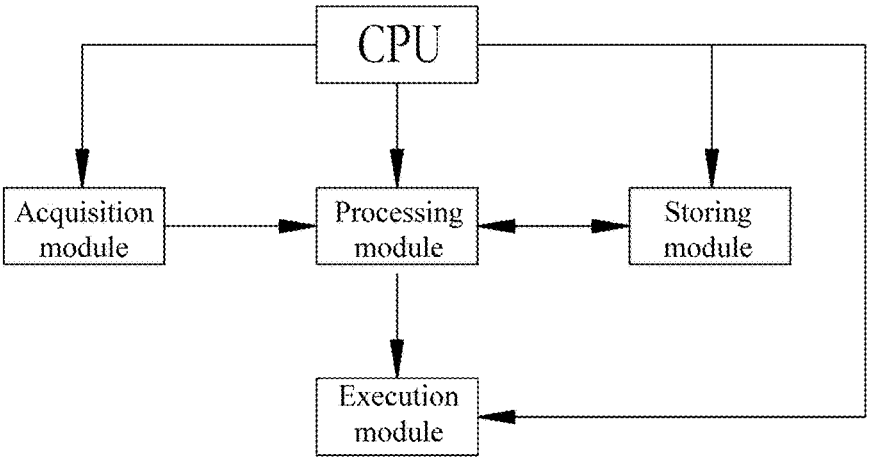
FIG. 14 is a schematic view of a control system for the banknote stacking device in FIG. 1.
Figure 15:
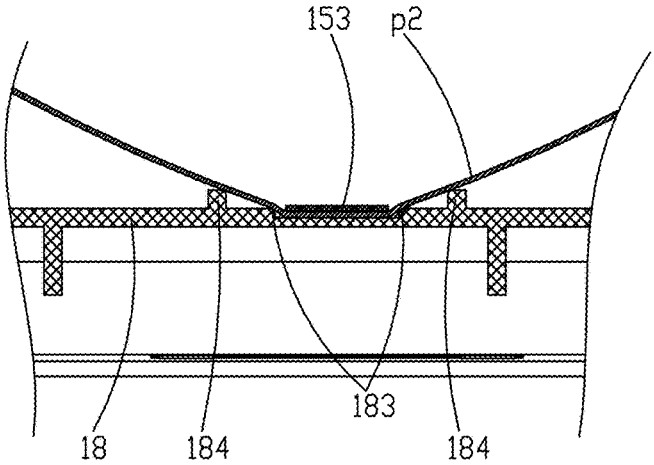
FIG. 15 is a sectional schematic view of the banknote at the position of convex ribs of the arc-shaped stacking plate in the stacking process.
Figure 16:
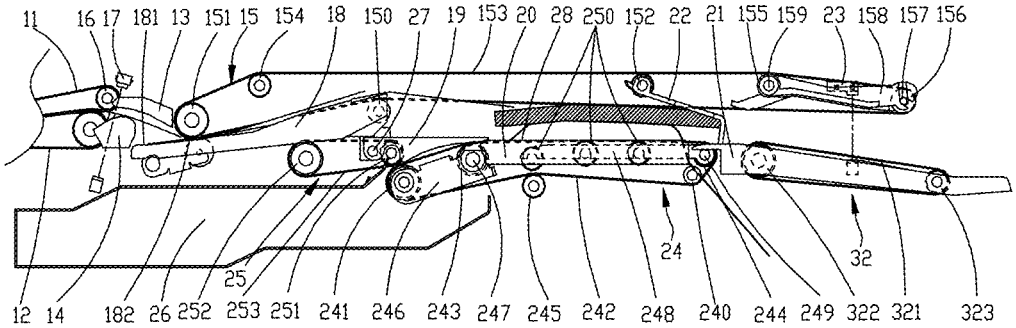
FIG. 16 is a schematic view of banknotes being stacked and aligned in the stacking and recycling device in FIG. 2.

Referring to FIGS. 13 to 17, the process for realizing the function of the stacking and recycling device is illustrated. When the banknotes are to be returned, the movable blocking plate 22 is in the closed state as shown in FIG. 13, to prevent the banknotes from moving in the advancing direction of banknotes. The pressing plate 158 is at the first position and the delivering floating support 248 is at the first position, to make the working surface of the upper section of the second conveyor belt 242 lower than the arc-shaped surface of the front arc-shaped plate 20, thus, when slipping along the arc-shaped plate, the banknotes will not contact the working surface of the second conveyor belt 242. The direction reversing device 19 is at the first position, to allow the banknotes to pass along the arc-shaped surface smoothly. A first sheet of banknote p1 is delivered out by the upper delivering conveyor belt 11 and the lower delivering conveyor belt 12, the front end of the banknote passes through the first sensor device 17 (an acquisition module), the sensor 17 feeds back an information to a processing module of the control system, and the processing module processes the information and then sends out a signal, to start a first driving motor (an execution module) immediately or start the first driving motor after a period of time, thereby driving the first conveying assembly 15, the second conveying assembly 24, the third conveying assembly 25 and the fourth conveying assembly 32 to rotate in the direction shown in FIG. 13. The first conveying assembly 15 cooperates with the rear arc-shaped plate 18 to convey the banknote forward, the sensor 17 feeds back an information to the processing module of the control system when the tail end of the banknote leaves the first sensor device 17, and the processing module processes the information and sends out a signal to stop the first driving motor, and in this case, all of the conveying assemblies are stopped, the banknote stops at position 182 with the tail end being exposed behind the first conveyor belt assembly 15. The front end of the first sheet of banknote p1 reaches the first pair of convex ribs 183 and the second pair of convex ribs 184. As shown in FIG. 15, due to the action on the front end of the first sheet of banknote p1 from the first conveyor belt 153, the first pair of convex ribs 183 and the second pair of convex ribs 184, the first sheet of banknote p1 is bent upward at two sides of the advancing direction, thus the section, perpendicular to the advancing direction, of the banknote forms a V shape. When a second sheet of banknote p2 is delivered out, the front end of the second sheet of banknote passes through the first sensor device 17, the first sensor device 17 feeds back an information to the control system, and the control system sends out a signal for starting the first driving motor, to start the first driving motor immediately or after a period of time, thereby driving the first conveyor belt assembly, the second conveyor belt assembly and the third conveyor belt assembly to rotate in the direction shown in FIG. 13. The front end of the second sheet of banknote p2 is superposed on the tail end of the first sheet of banknote p1, and the two sheets of banknotes which are partially overlapped are conveyed forward together by the first conveyor belt assembly 15. The first sheet of banknote p1 slides through the rear passage plate 18 and enters into a height difference area. Then, the first sheet of banknote p1 is clamped by the first conveyor belt 153 and the elastic sheet 28 to be conveyed forward stably, which effectively avoids the problem of the banknote being entered freely and being stacked disorderly. After the tail end of the second sheet of banknote p2 leaves the first sensor device 17, the first sensor device 17 feeds back information to the control system, and the control system stops the first driving motor, and the second sheet of banknote stops at the position 182. The third sheet of banknote and the subsequent banknotes are conveyed in the same manner, in which the front end of a subsequent sheet of banknote is superposed on the tail end of a previous sheet of banknote. When the front end of the first sheet of banknote p1 reaches the movable blocking plate 22, the banknote is prevented from moving forward, and slips with respect to the first conveyor belt 153. The action force on the banknotes from the first conveyor belt 153 is greater than the frictional force between the banknotes, thereby making the second sheet of banknote p2 and the first sheet of banknote p1 rub against each other to be aligned to the movable blocking plate 22. The rubbing process is illustrated as follow. Under the action of the first conveyor belt 153, the first pair of convex ribs 183 and the second pair of convex ribs 184, the second sheet of banknote p2 is bent upward at two side of the advancing direction, thereby making the section, perpendicular to the advancing direction, of the banknote form a V shape. The two sides of the second sheet of banknote p2 being bent upward makes the two sides of the second sheet of banknote p2 higher than the two sides of the first sheet of banknote p1, which intensifies the strength of the banknotes in the advancing direction. Therefore, when the second sheet of banknote p2 or the first sheet of banknote p1 have slits, the slits can be avoided in a certain extent. And if the banknote is blocked at the slit, the first conveyor belt 153 can provide an enough conveying force for the second sheet of banknote p2, to allow the second sheet of banknote p2 to cross the slit without being folded and arched. As shown in FIG. 16, the third sheet of banknote and the subsequent banknotes go through the same process, and the front ends thereof are eventually aligned to the movable blocking plate 22. As the height of the stacked banknotes increases, the elastic sheet 28 is adaptively lowered due to the pressing of the first conveyor belt 153 and the stacked banknotes, to allow a subsequent sheet of banknote to be substantially flush with a previous sheet of banknote, and in the rubbing process, the subsequent sheet of banknote is not required to climb a slope at the tail end of the stacked banknotes, which can effectively reduce the probability of the banknote having a slit being jammed at the tail end of the stacked banknotes. Finally, the front ends of the banknotes are aligned and the banknotes are stacked orderly as shown in FIG. 16.

Figure 17:
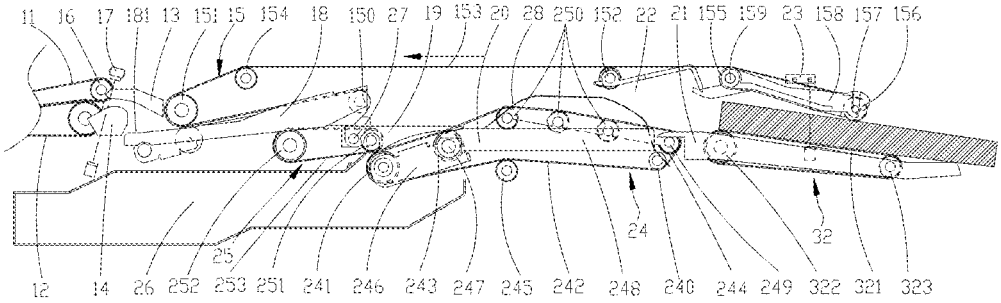
FIG. 17 is a schematic view showing a whole stack of banknotes being delivered out by the stacking and recycling device in FIG. 2.
Figure 18:
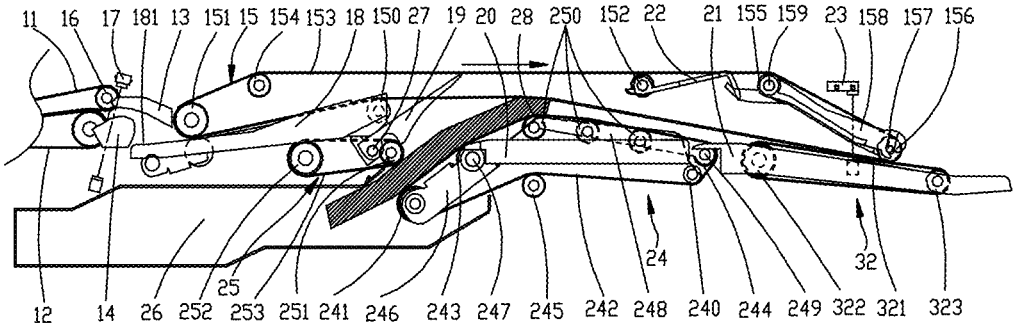
FIG. 18 is a schematic view showing a process of automatically recycling the whole stack of banknotes delivered out by the stacking and recycling device in FIG. 17 when the banknotes are not taken away.

After all of the banknotes are delivered out, that is, the banknotes have been processed, the control system sends out a signal to control the second motor, to shift the movable blocking plate 22 to the open state as shown in FIG. 17, thereby removing the blockage in the advancing direction of the banknotes. Meanwhile, the delivering floating support 248 is shifted to the second position to make the working surface of the second conveyor belt 242 higher than the upper arc-shaped surface of the front arc-shaped plate 20, thus the working surface of the second conveyor belt 242 is in contact with the banknotes. The first driving motor is started to drive the first conveyor belt assembly, the second conveyor belt assembly, the third conveyor belt assembly and the fourth conveyor belt assembly to rotate in the direction shown in FIG. 17. The banknotes are clamped between the first conveyor belt assembly 15 and the second conveyor belt assembly 22 to be delivered out, and the pressing plate 158 may automatically adjust the gap between the pinch roller 156 and the second pinch roller 224 according to the total thickness of the banknotes. According to the time counting of the controlling program, the transmission structure stops the conveyor belts when the banknotes are delivered out for a certain distance, and the tail ends of the banknotes are clamped between the pinch roller 156 and the second pinch roller 224, thereby accomplishing the delivering process. In the case that the whole stack of the delivered banknotes haven't been taken away by the operator timely, the movable blocking plate 22 and the direction reversing device 19 of the stacking and recycling device are shifted to the position as shown in FIG. 18, the control system controls the first conveyor belt assembly, the second conveyor belt assembly, the third conveyor belt assembly and the fourth conveyor belt assembly to rotate in the reversed direction, and the whole stack of banknotes are conveyed reversely under the action of the first conveyor belt assembly and the second conveyor belt assembly, and are blocked by the direction reversing device 19 and guided into the storage container 26 of the recycling unit in the reverse conveying process.

The embodiments described hereinabove are only preferred embodiments of the present application, and should not be interpreted as limitation to the present application. The technical solutions claimed by the present application not only can be applied to the financial field for processing banknotes, but also can process checks or other whole stack of sheet-type medium which are required to be separated piece by piece. Therefore, for those skilled in the art, a few of modifications and improvements may be made without departing from the spirit and scope of the present application, and theses modifications and improvements are also deemed to fall into the scope of the present application.

The invention claimed is:

1. A banknote stacking device, comprising:

a piece-by-piece banknote conveying mechanism configured to convey a single sheet of banknote;

an upper conveyor belt configured to provide a driving force to the banknote and arranged around a driving wheel, driven wheels and a pinch roller which are arranged in a conveying direction of the banknote;

an arc-shaped stacking plate configured to support the banknote, wherein the upper conveyor belt fitting closely to an arc-shaped surface of the arc-shaped stacking plate to define a conveying passage for the banknote, a length of the conveying passage is at least greater than a length of one sheet of the banknote in the conveying direction, and one end of the conveying passage abuts the piece-by-piece banknote conveying mechanism and is slightly lower than a delivering outlet of the conveying mechanism, and another end of the conveying passage forms a discharging port for a whole stack of banknotes;

a movable blocking mechanism arranged on a section of the conveying passage close to the discharging port and configured to selectively block the banknote;

a sensor device arranged at a tail end of the delivering outlet of the piece-by-piece banknote conveying mechanism and configured to detect the arrival and passing of a sheet of the banknote; and a control unit configured to control the upper conveyor belt to move or stop moving according to information feedback from the sensor device;

wherein, an elastic sheet is arranged on the arc-shaped stacking plate at a position for stacking banknotes, an end of the elastic sheet is fixed on the arc-shaped stacking plate, and a free end of the elastic sheet extends in a direction opposite to the conveying direction of the banknotes, the extending segment of the elastic sheet forms an arch and is configured to elastically support the upper conveyor belt, and a through-groove is provided in the arc-shaped stacking plate at a position corresponding to the elastic sheet, and the free end of the elastic sheet is configured to extend and retract freely in the through-groove.

2. The banknote stacking device according to claim 1, wherein the arc-shaped stacking plate comprises three sections, a section near the piece-by-piece banknote conveying mechanism forms a rear arc-shaped plate, a section near the discharging outlet forms a front arc-shaped plate, and a middle section forms a direction reversing device, wherein, the elastic sheet is arranged on the front arc-shaped plate, and an end of the rear arc-shaped plate close to the front arc-shaped plate tilts upward to be higher than a surface of the front arc-shaped plate to form a height difference.

3. The banknote stacking device according to claim 2, wherein at least one pair of convex ribs are formed on the surface of the rear arc-shaped plate at two sides of the upper conveyor belt, and a distance between the pair of convex ribs is smaller than the minimum dimension of the banknote in a direction perpendicular to the conveying direction.

4. The banknote stacking device according to claim 3, wherein a floating pinch roller is provided on a side, away from the arc-shaped plate, of the upper conveyor belt at a position corresponding to the convex ribs, and is configured to increase a conveying force of the upper conveyor belt to the banknote.

5. The banknote stacking device according to claim 2, wherein a recycling conveyor belt assembly and a discharging conveyor belt assembly are arranged below the direction reversing device and the front arc-shaped plate, wherein at least a section of the recycling conveyor belt assembly fits with a section of the discharging conveyor belt assembly to form a recycling conveying passage for the banknote.

* * * * *